US008105479B2

(12) United States Patent
Ou et al.

(10) Patent No.: US 8,105,479 B2
(45) Date of Patent: Jan. 31, 2012

(54) PROCESS AND APPARATUS FOR UPGRADING STEAM CRACKER TAR-CONTAINING EFFLUENT USING STEAM

(75) Inventors: John D. Y. Ou, Houston, TX (US); Glenn A. Heeter, The Woodlands, TX (US)

(73) Assignee: Exxonmobil Chemical Patents Inc., Houston, TX (US)

( * ) Notice: Subject to any disclaimer, the term of this patent is extended or adjusted under 35 U.S.C. 154(b) by 448 days.

(21) Appl. No.: 12/486,813

(22) Filed: Jun. 18, 2009

(65) Prior Publication Data

US 2010/0320119 A1 Dec. 23, 2010

(51) Int. Cl.
*C10C 3/02* (2006.01)

(52) U.S. Cl. ..... 208/44; 208/106; 208/128; 208/129; 208/130; 208/131; 208/132

(58) Field of Classification Search ..... 208/44, 208/106, 128–132
See application file for complete search history.

(56) References Cited

U.S. PATENT DOCUMENTS

| | | | |
|---|---|---|---|
| 3,691,058 | A | 9/1972 | Hamner et al. |
| 3,707,459 | A | 12/1972 | Mason et al. |
| 4,575,413 | A | 3/1986 | Pizzoni et al. |
| 5,215,649 | A | 6/1993 | Grenoble et al. |
| 7,358,413 | B2 | 4/2008 | Stell et al. |
| 7,408,093 | B2 | 8/2008 | Stell et al. |
| 7,465,388 | B2 | 12/2008 | Strack et al. |
| 7,560,020 | B2 | 7/2009 | Annamalai et al. |
| 7,582,201 | B2 | 9/2009 | McCoy et al. |
| 7,674,366 | B2 | 3/2010 | Strack et al. |
| 7,718,049 | B2 | 5/2010 | Strack et al. |
| 7,744,743 | B2 | 6/2010 | McCoy et al. |
| 7,749,372 | B2 | 7/2010 | Strack et al. |

(Continued)

FOREIGN PATENT DOCUMENTS

DE 43 08 507 9/1993

OTHER PUBLICATIONS

Ou et al., U.S. Appl. No. 12/023,204, filed Jan. 31, 2008.

(Continued)

*Primary Examiner* — Walter D Griffin
*Assistant Examiner* — Brian McCaig

(57) ABSTRACT

A process and apparatus are provided for the present invention relates to a process for upgrading tar-containing effluent from a steam cracker furnace that comprises: a) contacting a steam cracker tar-containing effluent with steam and for a time, sufficient to convert at least a portion of the steam cracker tar to a mixture comprising lower boiling molecules and the steam cracker tar-containing effluent; and b) separating the mixture from step a) into i) at least one tar-lean product; and ii) a tar-rich product having a final boiling above the final boiling point of the at least one tar-lean product. Step a) can includes at least one of: 1) contacting said steam cracker tar-containing effluent with steam added to the effluent in a transfer line downstream of a steam cracker furnace comprising a quench inlet, with the steam added through or downstream of the quench inlet; 2) contacting the steam cracker tar-containing effluent with steam under heat soaking conditions in a heat soaking vessel to which the steam is added; and 3) contacting the steam cracker tar-containing effluent with steam under visbreaking conditions in a visbreaker. The steam treated tar can be separated into higher value gas oil, fuel oil and tar streams.

20 Claims, 1 Drawing Sheet

U.S. PATENT DOCUMENTS

| | | | |
|---|---|---|---|
| 7,763,162 | B2 | 7/2010 | Strack |
| 7,780,843 | B2 | 8/2010 | Strack et al. |
| 7,815,791 | B2 | 10/2010 | Keusenkothen |
| 7,837,854 | B2 | 11/2010 | Ou et al. |
| 7,837,859 | B2 | 11/2010 | Ou et al. |
| 7,846,324 | B2 | 12/2010 | Annamalai et al. |
| 7,906,010 | B2 | 3/2011 | Keusenkothen et al. |
| 2007/0007174 | A1 | 1/2007 | Strack et al. |
| 2008/0053869 | A1 | 3/2008 | McCoy et al. |
| 2008/0083649 | A1 | 4/2008 | McCoy et al. |
| 2008/0116109 | A1 | 5/2008 | McCoy et al. |
| 2008/0221378 | A1 | 9/2008 | Stell et al. |
| 2009/0272671 | A1 * | 11/2009 | Keusenkothen ..... 208/44 |
| 2011/0005970 | A1 | 1/2011 | Ou et al. |

OTHER PUBLICATIONS

Ou et al., U.S. Appl. No. 12/099,971, filed Apr. 9, 2008.

English Abstract for DE 43 08 507.

* cited by examiner

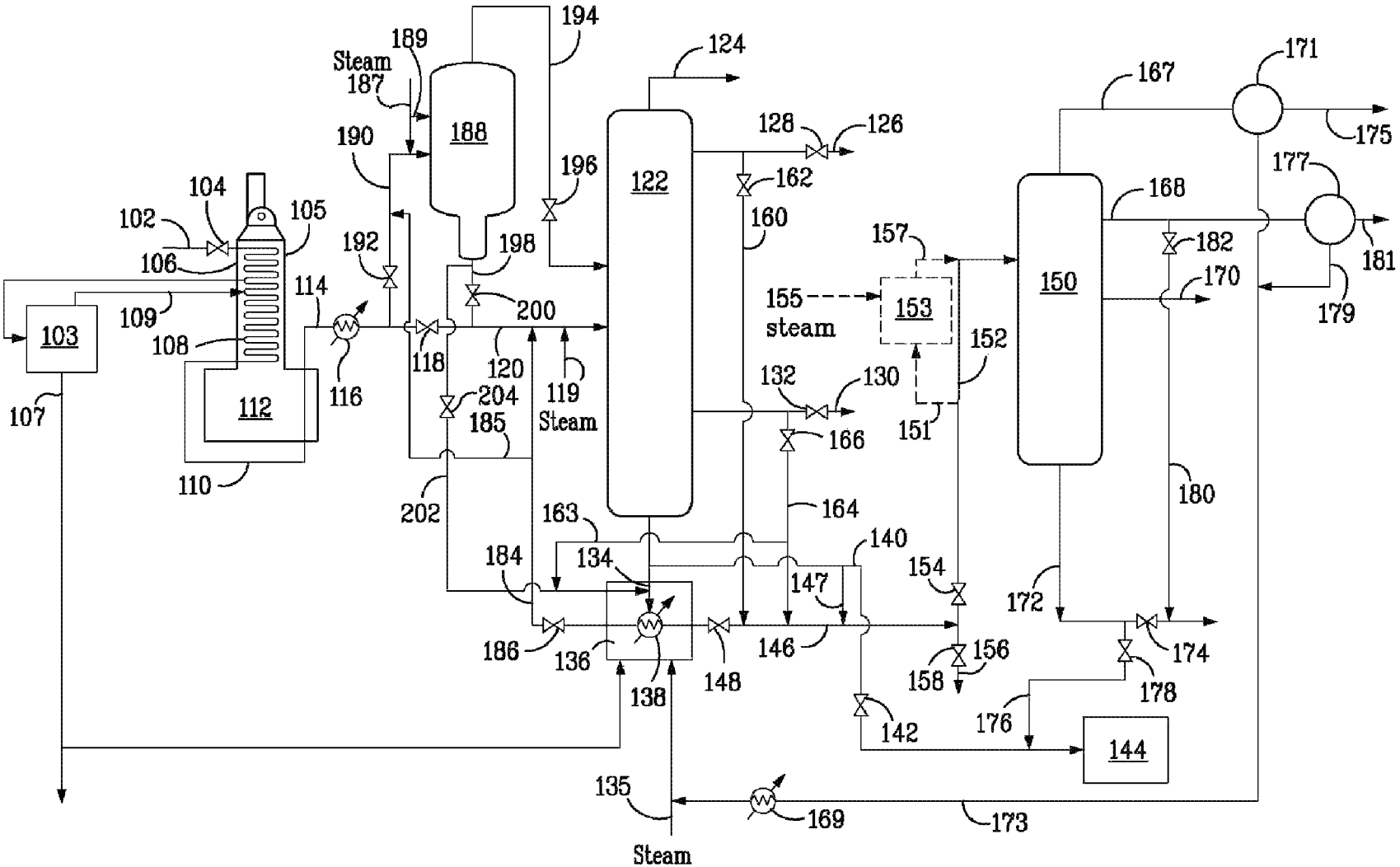
150
122
188
153
144
112
103
steam
Steam
Steam
Steam

PROCESS AND APPARATUS FOR UPGRADING STEAM CRACKER TAR-CONTAINING EFFLUENT USING STEAM

FIELD OF THE INVENTION

The present invention relates to the cracking of hydrocarbons, particularly hydrocarbon feeds containing non-volatile components that can produce steam cracker tar as a steam cracking product. More particularly, the present invention relates to cracking processes and apparatus that treats steam cracker tar fractions within the furnace effluent by exposure to steam, sufficiently early post-cracking so as to prevent or decrease formation of at least a portion of high boiling molecules, including asphaltene precursors, within the effluent stream. Exemplary high boiling molecules and precursors may include tar and asphaltenes.

BACKGROUND OF THE INVENTION

Steam cracking has long been used to crack various gaseous (e.g., light alkanes) or liquid (e.g., naphthas) hydrocarbon feedstocks into higher value products, such as olefins, preferably light olefins such as ethylene and propylene. In addition to naphthas, other liquid feedstocks of interest may include, for example, distillation resids or bottoms, gas oils, kerosenes, crudes, various other liquid separation product streams, and blends thereof. When cracking liquid feedstocks having final boiling points higher than naphthas, the steam cracking process often produces numerous by-products, such as various aromatic compounds, ash, metals, coke, asphaltenes, and other high weight materials including molecules that tend to combine to form high molecular weight materials commonly known as tar. Similarly, cracking heavier liquid feedstocks (e.g., feeds having a final boiling point above 260° C.) generally produce more tar than lighter liquid feeds such as naphthas. Tar is a high-boiling point, viscous, reactive material comprising many complex, ringed and branched molecules which can polymerize and foul equipment under certain conditions. Tar also typically contains high-boiling and/or non-volatile components including paraffin-insoluble compounds, such as pentane-insoluble (PI) compounds or heptane-insoluble (HI) compounds, which are molecules of high molecular weight, multi-ring structures, collectively referred to as asphaltenes. Asphaltenes content can progress for a time under various post-cracking conditions, particularly as the steam cracker effluent cools, particularly accelerated as the tar-containing effluent cools below 300° C. The term "final boiling point above X" means that at temperature X, a sample of the material still exhibits at least some non-volatized portions, at least a further portion of which may still be volatized at a temperature greater than X.

Tar and associated asphaltenic materials can precipitate buildup in, and plug piping, vessels, and related equipment downstream of the cracking furnace. Further, asphaltenic materials reduce the economic value and further processability of tar by rendering the tar highly viscous and less compatible for mixing or blending with highly paraffinic streams or for use with fuel streams. When so blended, the paraffinic streams and asphaltenes can further induce precipitation of the paraffin-insoluble components in the resulting mixture. Various methods are known in the art to treat tars produced from steam cracking liquid feedstocks.

U.S. Pat. No. 3,691,058, incorporated herein by reference in its entirety, discloses an integrated visbreaking-hydrocracking process to break down steam cracker tars into single-ring aromatics.

U.S. Pat. No. 3,707,459, incorporated herein by reference in its entirety, discloses visbreaking residua, e.g., thermal tar from steam cracking, in the presence of free radical acceptors, e.g., CaO, isooctane, and n-heptane.

U.S. Pat. No. 4,575,413, incorporated herein by reference in its entirety, discloses adding aluminum salts to reduce fouling in steam cracker tar streams.

DE 4308507 discloses reducing viscosity of heavy oil residues by treatment at high temperature (427° C.) with a hydrogen donor solvent comprising a fuel oil from steam cracking, which contains hydroaromatic compounds.

U.S. Pat. No. 5,215,649, incorporated herein by reference in its entirety, discloses producing gaseous olefins by cracking a hydrocarbon feedstock stream wherein the cracked product stream is quenched to stop cracking, followed by injecting hydrogen donor diluent, e.g., dihydronaphthalenes, which suppress molecular weight growth reactions forming undesirable high molecular weight materials such as asphaltenes.

U.S. application Ser. No. 12/023,204, filed Jan. 31, 2008, discloses upgrading steam cracker tar by heating from below 300° C. to a temperature above 300° C. for a time sufficient to convert at least a portion of the steam cracker tar to lower boiling molecules.

U.S. application Ser. No. 12/099,971, filed Apr. 9, 2008, discloses upgrading steam cracker tar by reheating the tar from temperatures below 300° C. to a temperature above 300° C. in the presence of steam for a time sufficient to convert at least a portion of the steam cracker tar to lower boiling molecules and subsequently separating the reheated steam cracker tar into one or more a tar-lean products and a tar-rich product boiling above the tar-lean products. However, the '971 invention primarily addresses reducing previously formed steam cracker tar, after the effluent has cooled for sufficient time to permit tar precipitation and polymerization.

SUMMARY OF THE INVENTION

It is desirable to provide an apparatus and process to either prevent initial formation or growth of asphaltenes within the tar and/or to enable conversion of an improved fraction of the steam cracker tar to more valuable, lower boiling materials. Moreover, it is also desirable to provide such apparatus and processes that are self-contained, treating steam cracked liquid hydrocarbon feedstock produced steam cracker tars, without use of relatively costly additive materials such as hydrogen, organic hydrogen donors, or aluminum compounds. In particular, it would be advantageous to provide an apparatus and process which contacts steam cracker tar-containing streams at one or more locations downstream of a steam cracker radiant section effluent outlet to contain or prevent tar and/or asphaltene formation.

It has recently been learned that the tar and asphaltene yield from a steam cracking process can be substantially reduced and that the asphaltene content of the remaining tar can also be substantially reduced by contacting the hot, steam cracker tar with substantial quantities of steam downstream of the steam cracker furnace. Preferably, at least a portion of any of such so-formed molecules may also be reduced to lower boiling fractions. The resulting steam-treated tar and tar-containing effluent can be separated to produce improved percentages of higher value, lower-boiling streams such as naphthas, gas oils, fuel oils, etc., as compared to untreated streams.

In some embodiments, the invention includes a process for upgrading tar-containing effluent from a steam cracker furnace comprising: a) feeding a hydrocarbon feedstock having a final boiling point above 260° C. to a steam cracking furnace containing a radiant section outlet producing a steam cracker tar-containing effluent; b) adding steam to at least a portion of said steam cracker tar-containing effluent of said radiant section outlet, while the tar-containing effluent is at a temperature of from 300° C. to 850° C. to form a steam-effluent mixture; and c) separating the steam-effluent mixture into i) at least one tar-lean product containing a first tar; and ii) a tar-rich product containing a second tar, the tar-rich product having a final boiling point above the final boiling point of the at least one tar-lean product. In other embodiments, the invention also includes a process wherein the asphaltene concentration in the second tar, (the tar content within the tar rich product), is no greater than a comparative asphaltene concentration in a steam cracker tar of that system and feedstock composition without the added steam.

In some embodiments, the steam is added in step b), at or between the radiant section furnace outlet and a primary fractionator. In another aspect, the present invention relates to a process for upgrading tar-containing effluent from a steam cracker furnace cracking a hydrocarbon feed having a final boiling point above 260° C. that comprises: a) contacting a steam cracker tar-containing effluent with steam and for a time, sufficient to convert at least a portion of the steam cracker tar to a mixture comprising lower boiling molecules and the steam cracker tar-containing effluent; and b) separating the mixture from step a) into i) at least one tar-lean product; and ii) a tar-rich product having a final boiling above the final boiling point of the at least one tar-lean product. Step a) may include at least one of: 1) contacting the steam cracker tar-containing effluent with steam added to the effluent in a transfer line downstream of a steam cracker furnace comprising a quench inlet, with the steam added through or downstream of the quench inlet; 2) contacting the steam cracker tar-containing effluent with steam under heat soaking conditions in a heat soaking vessel to which the steam is added; and 3) contacting the steam cracker tar-containing effluent with steam under visbreaking conditions in a visbreaker. Steam can be added at least one location selected from A) at the separating step b), B) upstream of the separating step b), and C) downstream of the separating step b).

The present invention also includes an apparatus for upgrading tar-containing effluent from a steam cracker furnace comprising: a) a steam cracker furnace having a radiant section outlet for discharging a steam cracker tar-containing effluent from the furnace, the furnace fed a hydrocarbon feed having a final boiling point above 260° C.; b) at least one transfer line for conveying the steam cracker tar-containing effluent from the furnace to or between at least one vessels downstream of the furnace; c) a steam line for directly adding steam to the steam cracker tar containing effluent downstream from the furnace through a steam inlet into at least one of the at least one transfer line and the at least one vessels, while the steam cracker tar-containing effluent is at a temperature of from 300° C. to 850° C. to form a steam-effluent mixture; d) at least one separator for separating the steam-effluent mixture into i) at least one tar-lean product containing a first tar; and ii) a tar-rich product containing a second tar, the tar-rich product having a final boiling point above the final boiling point of the at least one tar-lean product.

In other embodiments, the invention includes a separator upstream of the steam inlet to separate the steam cracker tar-containing effluent into i) at least one tar-lean product; and ii) a tar-rich product, the tar-rich product having a final boiling point above the final boiling point of the at least one tar-lean product. In other embodiments, the steam line introduces steam into the steam cracker tar-containing effluent at or downstream from a primary fractionator to form the steam-effluent mixture and the steam-effluent mixture is processed in a heat soaking vessel and/or a hydrocracking/visbreaking vessel.

Still other embodiments include an apparatus for cracking hydrocarbon feeds producing steam cracker tar-containing effluent comprising: a transfer line for receiving steam cracker tar-containing effluent containing steam cracker tar, the transfer line including a quench inlet, and an optional steam inlet at or downstream of the quench inlet; a separator for receiving at least a portion of the tar-containing effluent and separating the received effluent into i) at least one tar-lean product and ii) a tar-rich product; and a steam inlet in at least one of the transfer line and the separator for adding steam to at least a portion of the steam cracker tar-containing effluent while the tar-containing effluent is at a temperature of from 300° C. to 850° C.

BRIEF DESCRIPTION OF THE DRAWING

FIG. 1 depicts a simplified exemplary embodiment of a process schematic and apparatus for upgrading tars in a steam cracking plant environment using steam.

DETAILED DESCRIPTION

Unless otherwise stated, all percentages, parts, ratios, etc. are by weight. Ordinarily, a reference to a compound or component includes the compound or component by itself, as well as in combination with other compounds or components, such as mixtures of compounds. Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

In some embodiments of the process aspect of the present invention described in the above "Summary of the Invention," the heat soaking conditions include temperatures from 200° C. to 600° C., total pressures no greater than 1138 kPa (150 psig), and heat soaking times ranging from 0.01 to 100 hours, say, temperatures of 250° C. to 500° C., total pressures no greater than 448 kPa (50 psig), and heat soaking times ranging from 0.1 to 10 hours. In other embodiments, the invention relates to the process carried out on a steam cracker tar-containing effluent obtained as primary fractionator bottoms. In other embodiments, the post-cracking vessel bottoms or separator resid fractions are subject to further processes, such as visbreaking and heat soaking, wherein the steam is contributed at such further processes. In still another embodiment, the process comprises adding steam to the fractionator bottoms to provide a mixture, heating the mixture to at least 300° C., directing the heated mixture to the heat soaking vessel to effect formation of lower boiling molecules, and thereafter separating the resulting mixture to provide a low boiling steam cracker gas oil, a medium boiling stream of low sulfur fuel oil and a high boiling stream containing tar.

In yet another embodiment, the process comprises at least one of i) adding at least a portion of the steam cracker gas oil fraction, such as from a primary fractionator, to the high boiling stream to provide a fluxed tar stream and ii) directing at least a portion of the fluxed tar stream to a partial oxidation reactor for combusting. In yet still another embodiment, the invention relates to the process carried out on a steam cracker tar-containing effluent obtained as bottoms from a tar knockout drum. The tar knockout drum is typically located upstream of a primary fractionator, but also typically downstream of a quench system, such as a quench oil system and/or transfer line exchanger (TLE).

In another embodiment, the process further comprises separating effluent from the heat soaking vessel, visbreaker, and/or tar knockout into fractions. Separating the further processed effluent from the heat soaking vessel, visbreaker, and/or tar knockout fractions can provide a steam cracked gas oil stream, a low sulfur fuel oil stream, and a tar stream, which optionally further comprises adding at least a portion of the steam cracked gas oil stream to the tar stream. It has also been discovered that the tar stream from such processes may be usefully blended with the gas-oil streams into a mixture that is suitable for feeding to fuel oil blending or other further downstream processes.

In one embodiment, the process further comprises directing overheads from the tar knockout drum to a primary fractionator which provides a $C_4$-overhead stream, a steam cracked naphtha side stream, a steam cracked gas oil side stream, and a quench oil bottoms stream. In another embodiment, the process of the invention comprises directing the quench oil bottoms stream to the quench inlet, such as a quench oil and/or TLE. In still another embodiment, the process of the invention further comprises adding at least a portion of the steam cracked gas oil side stream to the tar knockout drum bottoms upstream of a further processing system, such as a visbreaker or heat soaker system.

In yet another embodiment, the process directs the steam cracker tar-containing effluent to a tar knockout drum that provides steam cracker tar which is treated by adding steam to the furnace effluent while the effluent is at temperature of at least 300° C., and wherein the steam is added to at least one of the tar knockout drum itself, a location upstream of the tar knockout drum, or a location downstream of the tar knockout drum. In still yet another embodiment, the process includes contacting the steam cracker tar-containing effluent in the transfer line downstream of a steam cracker furnace, with steam is preferably added to the transfer line at or downstream of the quench oil inlet. In yet still another embodiment, the process of the invention is one wherein the tar knockout drum is upstream of a primary fractionator.

In one embodiment, the process further comprises directing at least a portion of overheads from the tar knockout drum to the primary fractionator which provides a $C_4$-overhead stream, a steam cracked naphtha side stream, a steam cracked gas oil side stream, and a quench oil bottoms stream. In another embodiment, the process further comprises directing at least a portion of the quench oil bottoms stream to the quench inlet of the transfer line. In yet another embodiment, the process further comprises directing at least a portion of the steam cracked gas oil side stream to the steam cracker tar provided by the tar knockout drum.

An apparatus embodiment further comprises a line for introducing the steam cracked gas oil side stream to the tar bottoms stream. In another embodiment, the primary fractionator of the apparatus comprises an overhead outlet for a $C_4$-overhead stream, a side outlet for a steam cracked naphtha side stream, a side outlet for a steam cracked gas oil side stream, and a bottoms outlet for a quench oil bottoms stream. In still another embodiment, the apparatus of the invention further comprises a line from the side outlet for a steam cracked gas oil side stream for adding fluxant to a steam cracker tar stream. In yet another embodiment, the primary fractionator of the invention apparatus comprises an overhead outlet for a $C_4$-overhead stream, a side outlet for a steam cracked naphtha side stream, a side outlet for a steam cracked gas oil side stream, and a bottoms outlet for a steam cracker tar stream.

In still other embodiments, the invention may relate to an apparatus for upgrading steam cracker tar from a steam cracker furnace which comprises: a transfer line comprising an inlet for receiving hot steam cracker furnace effluent containing steam cracker tar, a quench oil inlet, and an optional steam inlet at or downstream of the quench oil inlet, and a cooled effluent outlet, a separator comprising at least one of i) a tar knockout drum comprising an overhead outlet and a bottoms outlet for a steam cracker tar stream, and ii) a primary fractionator comprising an overhead outlet, at least one side outlet, and a bottom outlet, provided that, in the presence of the tar knockout drum, the primary fractionator bottoms outlet provides a stream of quench medium to the quench inlet, while in the absence of the tar knockout drum, the primary fractionator bottoms outlet provides a steam cracker tar stream; an optional heat soaking vessel comprising a steam cracker tar stream inlet for receiving and holding the steam cracker tar under heat soaking conditions, and an outlet for heat soaking vessel effluent; an optional inlet for introducing steam at or upstream of the heat soaking vessel; an optional heater for adding heat to the steam cracker tar stream at or upstream of the heat soaking vessel; an optional heat soaking effluent separator for separating effluent from the heat soaking vessel into a steam cracked gas oil side stream, a low sulfur fuel oil side stream, and a tar bottoms stream; an optional visbreaker comprising a steam inlet, for receiving and holding the steam cracker tar under visbreaking conditions; an optional visbreaker effluent separator for separating effluent from the visbreaker into a steam cracked gas oil side stream, a low sulfur fuel oil side stream, and a tar bottoms stream; and an optional partial oxidation unit for treating the tar bottoms stream from at least one of the heat soaking effluent separator and the visbreaker effluent separator.

Exemplary suitable hydrocarbonaceous feeds for use in the present invention include naphtha boiling range materials, as well as those with a final boiling point in a temperature range from above 180° C., such as feeds heavier than naphtha. Such feeds include those boiling in the range from 93° C. to 649° C. (from 200° F. to 1200° F.), such as from 204° C. to 510° C. (from 400° F. to 950° F.). The inventive process is typically more applicable to cracking feeds heavier than naphthas, such as feeds more prone to tar precipitation. Typical heavier than naphtha feeds can include those feeds having final boiling points above 260° C. (500° F.), such as gas oil streams, heavy condensates, gas oils, kerosenes, hydrocrackates, low sulfur waxy residue, crude, atmospheric resid, vacuum resid, hydrotreated atmospheric resid, hydrotreated vacuum resid, hydrotreated crude, crude oils, and/or crude oil fractions.

The feeds can comprise a large portion, such as from 5% to 50%, of relatively high-boiling components, i.e., resid. Such feeds could comprise, by way of non-limiting examples, one or more of steam cracked gas oils and residues, gas oils, heating oil, jet fuel, diesel, kerosene, gasoline, catalytically cracked naphtha, hydrocrackate, reformate, raffinate reformate, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, hydrocarbon gases/residue admixture, hydrogen/residue admixtures, gas oil/residue admixture, and crude oil. Suitable whole crude oils include those containing high levels of nickel and vanadium such as found in Venezuela tars, for example. Solvent deasphalted (or deasphaltened) (SDA) fractions with and without resins, are especially suited for use as feedstocks in the present invention. The foregoing hydrocarbonaceous feeds can have a nominal end boiling point of at least 315° C. (600° F.), generally greater than 510° C. (950° F.), typically greater than 590° C. (1100° F.), for example, greater than 760° C. (1400° F.).

Asphaltenes in steam cracked tar or steam cracker tar can be determined quantitatively as the insolubles in paraffinic solvents. Steam cracked asphaltenes generally are composed of carbon, hydrogen, nitrogen, sulfur with a C:H atomic ratio of 2.0-1.0 and average molecular weight of 1000. They are brownish solids at ambient conditions, having a vaporization/decomposition temperature starting at 350° C. to 400° C. as determined by thermogravimetric analysis in nitrogen (heating rate 10° C./minute).

Among the wide range of paraffin insolubles which are formed upon heating and oxidation, the pentane-insolubles and heptane-insolubles, hereinafter designated as $C_5$-asphaltenes and $C_7$-asphaltenes, are of particular interest. Asphaltenes may be specified with reference to the particular paraffins in which they are insoluble, e.g., n-heptane, n-hexane, n-pentane, isopentane, petroleum ether, etc. For present purposes, asphaltene content of a sample can be determined by well-known analytic techniques, e.g., ASTM D6560 (Standard Test for Determination of Asphaltenes (Heptane Insolubles) in Crude Petroleum and Petroleum Products), ASTM D3270 (Standard Test Method for n-Heptane Insolubles), ASTM D4055-02 Standard Test Method for Pentane Insolubles by Membrane Filtration, and ASTM D-893, Standard Test Method for Insolubles in Used Lubricating Oils.

The feed may be initially heated by indirect contact with flue gas in a convection section tube bank of the pyrolysis furnace (or cracking furnace) before mixing with a dilution fluid, e.g., steam. Preferably, the temperature of the heavy feedstock is from 149° C. to 260° C. (300° F. to 500° F.) before mixing with the dilution fluid, preferably water and steam. Preferably, the steam cracker effluent is contacted by steam at a steam to hydrocarbon effluent ratio of at least 0.5:1, or more preferably at a ratio of at least 1:1, while such effluent is at a temperature of at least 300° C. In many embodiments, the steam to hydrocarbon ratio is at least 1.5:1, more in some embodiments preferably at least 2:1. Generally, for a given effluent stream, the lower the effluent temperature during addition of steam the higher the amount of steam required to effect a similar treatment result at such temperature. In many other embodiments the steam is added to the effluent while the effluent is at a temperature of at least 310° C., more preferably at least 325° C., still more preferably at least 350° C., and in many other embodiments while at a temperature of at least 400° C., or 450° C., or at least 500° C., or sometimes at effluent temperatures of up to 850° C.

Following mixing with the primary dilution steam stream, the mixture stream may be separated or partially separated prior to further treating, or the treated effluent stream or portions thereof may be reheated or further heated, such as by indirect contact with flue gas in a first convection section of the pyrolysis furnace before being flashed. Preferably, the first convection section is arranged to add the primary dilution steam stream, between subsections of that section such that the hydrocarbonaceous feeds can be heated before mixing with the fluid and the mixture stream can be further heated before being flashed. The temperature of the flue gas entering the first convection section tube bank is generally less than 816° C. (1500° F.), for example, less than 704° C. (1300° F.), or less than 621° C. (1150° F.), and preferably less than 538° C. (1000° F.).

Dilution steam may be added at any point in the process, for example, it may be added to the feedstock before or after heating, to the mixture stream, and/or to the vapor phase. Any dilution steam stream may comprise sour steam. Dilution steam stream may be heated or superheated in a convection section tube bank located anywhere within the convection section of the furnace, preferably in the first or second tube bank.

The mixture stream may be at 316° C. to 538° C. (600° F. to 1000° F.) before introduction to an optional vapor/liquid separator or flash apparatus, e.g., knockout drum, situated between the convection section and the radiant section of the furnace. The flash pressure can be any suitable pressure, e.g., 40 to 200 psia (275 to 1375 kPa). Following the flash, 50 to 98% of the mixture stream can be in the vapor phase. The vapor phase can be heated above the flash temperature before entering the radiant section of the furnace, for example, to 427° C. to 704° C. (800° F. to 1300° F.). This heating may occur in a convection section tube bank, preferably the tube bank nearest the radiant section of the furnace, in the lower convection zone.

The temperature of the gaseous effluent at the furnace outlet from the radiant section is normally in the range of from 760° C. to 929° C. (1400° F. to 1705° F.). The hot gaseous effluent which contains a steam cracker tar fraction can be cooled by a suitable heat exchange means, e.g., a transfer line exchanger and/or supplemental heat exchanger to a temperature below 300° C. (572° F.), e.g., a temperature below 280° C. (536° F.), or even below 270° C. (518° F.).

The resulting cooled cracked effluent can be directed to a suitable separation means such as a tar knockout drum prior to further processing in a separation zone. The flash pressure utilized can be any suitable pressure, e.g., from 0 to 185 psig (101 to 1374 kPa). The overhead of the tar knockout drum, containing molecules having boiling points less than 300° C., can be directed to a separation means for further processing, e.g., to a primary fractionator. The bottoms containing tar can be disposed of or directed to further processing and/or to a suitable separation means for subsequent further processing, e.g., to a primary fractionator or visbreaker or heat soaker system. In one embodiment, the bottoms containing tar from the tar knockout drum can themselves be used as at least a portion of the cooled steam cracker tar which is heated from below 300° C., such as from at least 250° C. or at least 280° C., to a temperature above 300° C. in accordance with the invention.

The cooled, cracked effluent from the heat exchange means downstream of the pyrolysis reactor which contains a steam cracker tar fraction can be directly taken to a separation zone (bypassing the tar knockout drum, if present). The separation zone can comprise one or more fractionators, one or more extractors, one or more membranes, or combinations thereof. Preferably, the separation zone comprises a primary fractionator. The separation zone divides the stream into one or more tar-lean lighter cuts, e.g., steam cracked naphtha boiling in a range from 10° C. to 250° C. (50° F. to 482° F.), say, from 25° C. to 210° C. (77° F. to 410° F.), and steam cracked gas oil, boiling in a range from 200° C. to 300° C. (392° F. to 572° F.), say, from 210° C. to 295° C. (410° F. to 563° F.), as well as a heavy steam cracker tar-rich fraction, typically boiling above 300° C. (572° F.).

The resulting steam cracker tar fraction is collected at a temperature of at least 300° C. (572° F.). This steam cracker tar may then treated via the addition of steam in accordance with the present invention to prevent precipitation of asphaltenes within the tar and reduce the formation of tar, thereby enhancing the value and usefulness of the remaining precipitated tar. This can be done by reducing the ultimate yield of low value steam cracker tar from the process while obtaining increased yields of lighter, more valuable fractions, such as steam cracked gas oil, low sulfur fuel oils, or streams compatible therewith. Moreover, the remaining steam cracker tar provided by the present invention can be reduced in asphaltene content and viscosity. Such reduction in viscosity reduces or eliminates the amount of lower viscosity, higher value flux materials, e.g., steam cracked gas oil that is necessary to upgrade the steam cracker tar to specification. Additional upgrade value can be achieved by splitting the remaining tar into a light stream and a heavy stream, where the light stream can be blended into fuel oil without causing incompatibility problems for the resulting blended fuel oil.

While not wishing to be bound by theory, applicants believe the present invention achieves a substantial reduction in steam cracker tar and asphaltene content by steam treating the effluent steam cracker tar and asphaltenes in the presence of steam at a temperature sufficient sufficiently high (e.g., at least 300° C.) so as to crack, prevent polymerization, and/or otherwise modify asphaltenes and asphaltene precursors into lower boiling molecules before the asphaltenes and tar reach lower temperatures (e.g., less than 300° C.) where precipitation and polymerization are much more prevalent. However, it is within the scope of the invention according to some embodiments for the effluent to be cooled to a temperature below 300° C., such as to 280° C. or 250° C. or even briefly to 200° C., and then reheated to a temperature above 300° C., such as via visbreaking, heat soaking, or the like, and then contacted with steam according to the invention. In such re-heated embodiments, preferably the effluent is not maintained below 300° C. for more than a few minutes, such as not longer than about five minutes and more preferably for not longer than about three minutes. Thereby, it remains within the scope of the invention to add steam to the tar-containing effluent stream or at least portions thereof, at substantially any point downstream of the steam cracker radiant section outlet through final separation of the effluent or portions thereof into one or more tar-lean streams and a tar rich bottoms stream. The downstream location limit of the inventive process can be at a point of separation of a concentrated tar containing stream, such as a tar-rich bottoms stream. For example, such terminal location may be in some embodiments at the tar knockout drum, or in other embodiments at the primary fractionator, in other embodiments at a visbreaker or hydrotreater or heat soaker or the like system, or in still other embodiments within a tar collection tank. Thus, the downstream limit of the inventive process and apparatus is thus highly variable and may be done at any point downstream of the radiant outlet so long as the effluent or portions thereof is at a temperature of at least 300° C., or sometimes preferably at least 350° C. When the process requires reheating or further heating the effluent stream, the steam may be added to a reheating vessel, for example, such as through a steam inlet or into a line flowing into the vessel or into an effluent-containing line entering the vessel. Steam can be added to the steam cracker tar-containing effluent substantially any convenient point in the post-cracking process, but preferably at a point where the effluent is at a temperature of at least 300° C. The steam stream utilized may comprise either non-sour or sour steam. The steam stream may be heated or superheated as necessary in a suitable heating means, such as an external heat exchanger, a steam drum, or a convection section tube bank located anywhere within the convection section of the furnace.

The steam cracker tar, typically obtained from a tar knockout drum and/or separation zone, as discussed above, is treated or reheated and then treated in the presence of steam at a temperature, pressure, and a time sufficient to convert at least a portion to lower boiling molecules. For present purposes, such a portion can be that part of the steam cracker tar whose conversion to lower boiling molecules can be measured using techniques known to those skilled in the art, e.g., gas chromatography or infrared spectroscopy. Such a portion can range from 0.01 wt. % to 100 wt. %, typically from 1 wt. % to 100 wt. %, say, from 10 wt. % to 100 wt. %, of the steam cracker tar stream that is heated. Such heating is typically carried out downstream of the separation zone and/or tar knockout drum with a suitable heat transfer means, e.g. a furnace, to provide the required heat. Typically, the steam cracker tar can be heated to a temperature above 300° C. (572° F.), say, above 320° C. (608° F.), or even above 350° C. (662° F.), at a pressure ranging from 101 to 2748 kPa (0 psig to 400 psig), say, at a pressure ranging from 101 to 788 kPa (0 psig to 100 psig), and for a period of time of at least 0.01 minutes, say, ranging from 0.01 to 1200 minutes, typically from 0.1 to 120 minutes, or more particularly, from 0.1 to 60 minutes. The amount of time necessary to effect the desired conversion of steam cracker tar to lower boiling molecules can vary depending on such factors as the temperature of the steam cracker tar, pressure, the weight ratio of steam to hydrocarbon, and the rate of heat transfer to the steam cracker tar. Thus, if the steam addition is done under flashing conditions, the amount of time needed may be less than that required under, for example, heat soaking or hydrocracking/visbreaking conditions.

After the steam cracker tar is sufficiently steam treated to reduce asphaltene and other tar molecules content, the steam-treated steam cracker tar can be collected as an asphaltene-reduced tar. Treating time required for the steam to effect inhibition of tar or asphaltene precursor growth or polymerization in the effluent is quite variable depending upon factors such as effluent temperature and steam temperature during treatment, amount of steam added, hydrocarbon partial pressure, vessel or line pressure, rate of mixture cooling, and similar variables. Generally, however, the required steam treating time is less than a few minutes, such as less than about five minutes, or less than three minutes, or less than thirty seconds, or less than ten seconds, or less than two seconds. In many applications, the treating effect may be substantially instantaneous, for example, not greater than one second, ore even not greater than half a second, such as for embodiments where the effluent has only very recently exited from the steam cracker and is still very hot, has just passed through the first transfer line exchanger and the primary function of the steam treatment is to prevent formation and precipitation of the tar and asphaltene precursors.

Preferably, the stream containing steam-treated tar is directed to a suitable separating means, e.g., a tar knockout, primary fractionator, extractor, visbreaker vessel, and/or separation membrane, which fractionates or divides the stream into a plurality of product streams, including at least one or more lower temperature boiling range products and a higher temperature boiling range product such as a bottoms product, the latter still containing a tar component. In a typical embodiment, the product streams include at least 1) a steam cracked gas oil (SCGO) stream, boiling in a range from 200° C. (392° F.) to 310° C. (590° F.), say, from 210° C. (410° F.) to 295° C. (563° F.), 2) a low sulfur fuel oil (LSFO)-compatible stream boiling in a range from 300° C. (572° F.) to 510° C. (950° F.), say, from 310° C. (590° F.) to 482° C. (900° F.), 3) a residual stream containing at least 2 wt % or at least 5 wt. % asphaltenes and boiling above 300° C. (572° F.), and 4) spent steam. In the event it is desired to produce a tar stream similar to one obtained without heat and steam-treating according to the invention, the residual stream can be fluxed with a lighter boiling fraction as necessary to provide a tar stream of the same or similar ratio as the non steam-treated tar. The steam cracked gas oil-cut stream can be used for example, as the flux.

The tar-lean product contains a lesser proportion of tar by weight than the steam cracker tar that is to be upgraded, say, at least 5 wt. % less, typically at least 25 wt. % less, e.g., at least 50 wt. % less. The tar-rich product contains a greater proportion of tar by weight than the steam cracker tar that is to be upgraded, say, at least 5 wt % more, typically at least 25 wt. % more, e.g., at least 50 wt. % more. The steam cracker tar can be derived from hot gaseous effluent from a steam cracking furnace, which has been cooled, e.g., by heat exchange and separated to provide a stream rich in tar, for example, at least 10 wt. % or typically at least 25 wt. % tar.

Suitable visbreaking conditions for the purpose of the invention may include temperatures ranging from 300° to 600° C. and pressures ranging from 1482 to 8377 kPa (200 to 1200 psig), say, 400° to 500° C. and pressure ranging from 2172 to 5619 kPa (300 to 800 psig).

In some embodiments, the invention includes a process for upgrading tar-containing effluent from a steam cracker furnace comprising: a) feeding a hydrocarbon feedstock having a final boiling point above 260° C. to a steam cracking furnace containing a radiant section outlet producing a steam cracker tar-containing effluent; b) adding steam to at least a portion of said steam cracker tar-containing effluent of said radiant section outlet, while the tar-containing effluent is at a temperature of from 300° C. to 850° C. to form a steam-effluent mixture; and c) separating the steam-effluent mixture into i) at least one tar-lean product containing a first tar; and ii) a tar-rich product containing a second tar, the tar-rich product having a final boiling point above the final boiling point of the at least one tar-lean product.

In other embodiments, the invention also includes a process wherein the asphaltene concentration in the second tar (within the tar rich product), is no greater than a comparative asphaltene concentration in a steam cracker tar of that system and feedstock composition without the added steam. Stated differently, the steam treatment is capable of upgrading all of the tar and asphaltene precursors and preventing asphaltene growth such that even the asphaltene concentration within the tar-rich product does not exceed the asphaltene concentration of untreated tar product.

In some embodiments, the steam is added as in above step b), between the radiant section furnace outlet and downstream to or in a primary fractionator. For example, such locations may include substantially in or immediately down stream of a quench header or TLE quench system, or proximate to or in a tar knockout system, or proximate to or in a primary fractionator system, and/or in between any of these aforementioned systems.

In other embodiments, steam may be added at any point and to any fractioned tar-containing stream discharging from a primary separation vessel, such as from a tar knockout or primary fractionator and downstream to and including any subsequent processes involved in handling the tar, such as a visbreaking, hydrotreating, heat soaking, or partial oxidation process. For example, in some embodiments, the steam line introduces steam into the steam cracker tar-containing effluent at or downstream from a primary fractionator to form the steam-effluent mixture and the steam-effluent mixture is processed in at least one of a heat soaking vessel, a visbreaking vessel, a hydrotreating vessel, or partial oxidation vessel. Other embodiments may include a primary fractionator downstream from the radiant outlet, the primary fractionator including a bottoms outlet for conveying at least a portion of the tar-rich product from the primary fractionator, and wherein the steam line adds steam to the tar-rich product downstream from the bottoms outlet. Other embodiments, for example, may include a tar knock-out drum, the tar-knockout drum including a tar-knockout drum bottoms outlet for conveying at least a portion of the steam cracker tar-containing effluent from the tar-knockout drum as the tar-rich product. In still further exemplary embodiments according to the invention, a steam line may add steam to the steam cracker tar-containing effluent in at least one of 1) upstream of the tar-knockout drum, 2) in the tar knockout drum, and 3) downstream of the tar knockout drum bottoms outlet, wherein the tar knockout drum is upstream of a primary fractionator.

In many embodiments, the invention includes an apparatus for upgrading tar-containing effluent from a steam cracker furnace comprising: a) a steam cracker furnace useful for cracking a hydrocarbon feed having a final boiling point above 260° C., the furnace having a radiant section outlet for discharging a steam cracker tar-containing effluent from the furnace; b) at least one transfer line for conveying the steam cracker tar-containing effluent from the furnace to or between at least one vessels downstream of the furnace; c) a steam line for adding steam to the steam cracker tar containing effluent downstream from the furnace through a steam inlet into at least one of the at least one transfer line and the at least one vessels, while the steam cracker tar-containing effluent is at a temperature of from 300° C. to 850° C. to form a steam-effluent mixture; d) at least one separator for separating the steam-effluent mixture into i) at least one tar-lean product containing a first tar; and ii) a tar-rich product containing a second tar, the tar-rich product having a final boiling point above the final boiling point of the at least one tar-lean product.

In other embodiments, the invention also includes a separator upstream of the steam inlet to separate the steam cracker tar-containing effluent into i) at least one tar-lean product; and ii) a tar-rich product, the tar-rich product having a final boiling point above the final boiling point of the at least one tar-lean product. In other embodiments, the steam line introduces steam into the steam cracker tar-containing effluent at or downstream from a primary fractionator to form the steam-effluent mixture and the steam-effluent mixture is processed in a heat soaking vessel and/or a hydrocracking/visbreaking vessel.

Still other embodiments include an apparatus for cracking hydrocarbon feeds producing steam cracker tar-containing effluent comprising: a transfer line for receiving steam cracker tar-containing effluent containing steam cracker tar from a furnace radiant section, the furnace suitable for cracking a hydrocarbon feedstock having a final boiling point above 260° C., the transfer line including a quench inlet, and an optional steam inlet at or downstream of the quench inlet; a separator for receiving at least a portion of the tar-containing effluent and separating the received effluent into i) at least one tar-lean product and ii) a tar-rich product; and a steam inlet in at least one of the transfer line and the separator for adding steam to at least a portion of the steam cracker tar-containing effluent while the tar-containing effluent is at a temperature of from 300° C. to 850° C.

In a simplified depiction of one embodiment of the present invention illustrated in FIG. 1, a hydrocarbonaceous feed stream 102, e.g., atmospheric resid or crude, is controlled by feed inlet valve 104 and the resulting feed is heated in an upper convection section 105 of a furnace 106. A steam stream and/or water stream (not shown) can be introduced to the hydrocarbons in the upper convection section. The resulting mixture is further heated in the convection section where all of the water vaporizes and a large fraction of the hydrocarbon vaporizes. Typically, this heating is carried out to a temperature up to 454° C. (850° F.), e.g., a temperature ranging from 204° C. to 482° C. (400° F. to 900° F.).

Exiting upper convection section 105, the mixture stream may be at a temperature of for example up to 454° C. (850° F.) and can enter an optional vapor/liquid separation apparatus or flash drum 103 for use with heavy feeds where a vapor/liquid separation occurs with heavy liquid bottoms being withdrawn (not shown) or recycled via line 107 to heating vessel 136. Vapor overhead is directed to the convection section via line 109.

The steam/hydrocarbon vapor from the upper convection section (or that derived from the flash drum overhead where a flash drum is used) passes from the lower convection section 108 via crossover piping 110 and through the radiant section 112 of the furnace where it undergoes cracking. The cracked effluent exits the radiant section through a quench header apparatus comprising a transfer line 114 which relays the effluent from the radiant section of the steam cracker to a separation device such as a knockout drum and/or primary fractionator. The transfer line may itself comprise an integral heat exchange means or a separate heat exchange means 116 can substitute for or supplement the integral heat exchange means. The heat exchanger(s) may reduce the temperature of the cracked effluent to a temperature of for example, less than 400° C. or even down to 300° C. (572° F.). A valve 118 controls the flow of cooled cracked effluent via line 120 to a (primary) fractionator 122. Steam can be added to the steam cracker tar-containing effluent in transfer line 114 through line 119, in accordance with the present invention, preferably downstream of the location where the quench inlet 184 joins the transfer line 114. The steam can be added in an amount sufficient to provide a steam to hydrocarbon ratio of 0.1 to 4 (0.1:1 to 4:1), preferably from 0.5 to 4, or sometimes more preferably from 1 to 4 (e.g., 1:1 to 4:1), not including any weight of steam or water added to the hydrocarbon feed during convection heating or prior to cracking, such as in a convection section sparger. The overall pressure in the line can be maintained for example, within the range of 101 to 1010 kPa. The steam can be obtained from any suitable source, e.g., high pressure steam, medium pressure steam, and sour steam. For purposes of the present invention, the term "steam cracker tar-containing effluent" includes effluent from the steam cracker furnace radiant section, as well as steam cracker tar-rich fractions which have been separated from the steam cracker furnace effluent by distillation, fractionation, as well as by any other suitable separation means such as flash separation.

In some embodiments, such as illustrated in FIG. 1, a stream containing $C_4$-hydrocarbons is taken as overhead via line 124, while steam cracked naphtha is taken as an upper side stream via line 126 controlled by valve 128, and a steam cracked gas oil fraction is taken as a lower side stream via line 130, controlled by valve 132. Steam cracker tar is taken as a bottoms fraction having a temperature below 300° C. (572° F.) via line 134. In one embodiment, the steam cracker tar is directed to a heating vessel 136, which can be a heat soaking vessel, comprising a heating means 138, e.g., a furnace, where the steam cracker tar is heated to a temperature above 350° C. (662° F.), for example, 400° C. (752° F.), with a residence time of from 0.1 to 60 minutes. Steam at a temperature above 300° C. (572° F.) can be added to the heating vessel via line 135 in an amount sufficient to provide a steam to hydrocarbon (bottoms fraction) ratio of 0.1 to 4. The overall pressure in the heating vessel can be maintained within the range of 101 to 1010 kPa. The steam can be obtained from any suitable source, e.g., high pressure steam, medium pressure steam, and sour steam. In one embodiment, heat soaking conditions are maintained in the vessel including, for example, temperatures from 300° to 600° C., total pressures no greater than 1138 kPa (150 psig), say, no greater than 448 kPa (50 psig), e.g., no greater than 101 kPa (0 psig), and heat soaking times ranging from 0.01 to 100 hours. In some embodiments, a portion of the steam cracker tar can be directed from line 134 via line 140 controlled by valve 142 to a partial oxidation unit (POX) 144, which is widely utilized in the chemical and petroleum industries to convert heavy hydrocarbons to synthetic gas. Thus, the steam cracker tar can be utilized as POX feedstock.

At least a portion of the heat and steam-treated steam cracker tar may be directed from line 134 via line 146 controlled by valve 148 to a separating means, e.g., fractionator 150 via line 152 controlled by valve 154. As desired, the heat and steam-treated steam cracker tar can be collected directly from line 146 via line 156 controlled by valve 158. If necessary, the heat and steam-treated steam cracker tar in line 146 can be diluted or fluxed with a diluent, e.g., steam cracked naphtha taken from line 126 via line 160 controlled by valve 162, and/or a steam cracked gas oil stream taken from line 130, via line 164 controlled by valve 166. Steam cracked gas oil can be directed to the heating vessel 136 via lines 163 and 202.

In other embodiments, the steam cracker tar bypasses the heat soaking vessel 134 via line 147 and passes through line 152 where it is directed via line 151 to visbreaker 153 and then passed to the separating means 150. Steam can be added at a suitable location to the steam cracker tar-containing effluent in the visbreaker 153, e.g., via line 155. The steam can be added in an amount sufficient to provide a steam to hydrocarbon ratio of 0.1 to 4. The overall pressure in the line can be maintained within the range of 101 to 8080 kPa. The steam can be obtained from any suitable source, e.g., high pressure steam, medium pressure steam, and sour steam. Visbreaking conditions suitable for this embodiment include 300° to 600° C., at pressures ranging from 1482 to 8377 kPa (200 to 1200 psig). Sufficient visbreaking for present purposes can be determined by suitable criteria such as residence time, viscosity measurement of visbreaker effluent, and final boiling point of visbreaker effluent. When sufficient time has passed for desired visbreaking to occur, the visbroken product is directed via line 157 to the primary fractionator 150.

The primary fractionator 150 resolves the steam treated or heat- and steam-treated steam cracker tar stream via line 157 into an overhead stream of naphtha and lighter materials, as well as entrained steam/water via line 167 to a condenser 171 for separating out steam/water for recycle to heating vessel 136 via line 173 through heater 169 (to convert water to steam) and steam injection inlet 135. Naphtha and lighter materials are taken from the condenser 171 via line 175. Similarly, a steam cracked gas oil stream with entrained steam/water is taken as an upper side stream via line 168 to a condenser 177 for separating out steam/water for recycle via lines 179 and 173. Steam cracked gas oil is taken from the condenser 177 via line 181. A low sulfur fuel oil-compatible stream is taken as a lower side stream of fractionator 150 via line 170. A low value tar stream rich in asphaltenes can be collected as bottoms via line 172 controlled by valve 174. If desired, the tar stream can be directed to partial oxidizer 144 via line 176 controlled by valve 178. The low value tar stream can be fluxed by adding a diluent such as a steam cracked gas oil stream, e.g., by diverting at least a portion of the steam cracked gas oil stream to line 172 from line 168 via line 180 which is controlled by valve 182. At least a portion of the steam-treated steam cracker tar may be recycled to the fractionator 122 via line 184 controlled by valve 186 to effect separation of lower boiling, more valuable components resulting from the heat and steam-treatment of the steam cracker tar.

Optionally, at least a portion of the cooled cracked effluent in line 120 can be diverted to a tar knockout drum 188 via line 190 (which for present purposes can be considered a portion of a transfer line) controlled by valve 192. Overhead is taken from the drum and directed to fractionator 122 via line 194 controlled by valve 196. A tar-rich fraction can be taken as bottoms via line 198 controlled by valve 200. Optionally, at least a portion of the tar fraction can be sent directly to the heating vessel 136 via line 202 controlled by valve 204. Steam may be directed into the tar knockout drum via line 187, preferably at a location downstream of an alternate quench inlet fed by line 185 which can be fed with a suitable quench medium, e.g., quench oil derived from steam cracker tar bottoms from line 184. Steam can be added directly to the tar knockout drum via line 189.

TABLE 1 below sets out the respective fractions present in a typical steam cracker tar and fractions present after a sample of the same tar is heat-treated at 400° C. ($H_2O$/HC=0), or heat and steam-treated in accordance with the present invention at 400° C. at 103 kPa (15 psig) ($H_2O$/HC=2). In this test, the reactor was a 0.6 cm (¼") stainless steel tubing placed inside a furnace maintained at 400° C. A mixture of 50 wt. % tar and 50 wt. % 1-methyl-naphthalene was pumped into the reactor continuously at the flow rate of 0.069 cc/min. If needed, water was vaporized in a preheater at the rate of 0.138 cc/min and directed into the reactor. The reactor effluent was condensed and collected in a chilled condenser. Water was separated from the hydrocarbons, which was analyzed for boiling point distribution and concentrations of asphaltenes and coke. Each sample was thereafter subjected to heat soaking for 15 minutes at 300° C. The results show that addition of steam results in a significant decrease in asphaltenes produced, even after heat soaking.

TABLE 1

| Fraction | BOP Tar, wt. % | Tar @ 400° C., 103 kPa, $H_2O$/HC = 0, wt. % | Tar @ 400° C., 103 kPa, $H_2O$/HC = 2, wt. % |
|---|---|---|---|
| <293° C. | 19 ± 1.1 | 24 ± 2.0 | 29 ± 2.1 |
| 293°-566° C. | 47 ± 1.0 | 48 ± 1.7 | 54 ± 2.3 |
| >566° C. | 15 ± 0.5 | 9 ± 1.0 | 5 ± 1.8 |
| Asphaltenes | 19 ± 0.5 | 16 ± 1.5 | 8 ± 3.5 |
| Coke | 0 | 3 ± 2.3 | 4 ± 1.5 |
| After Heat Soaking 15 minutes @ 300° C. | | | |
| <293° C. | 20 | 23 ± 1.3 | 30 ± 2.8 |
| 293°-566° C. | 47 | 50 ± 1.3 | 52 ± 2.1 |
| >566° C. | 13 | 10 ± 1.7 | 8 ± 3.1 |
| Asphaltenes | 20 | 17 ± 2.0 | 10 ± 3.8 |

TABLE 2 below sets out the results from a simulated visbreaker treatment of a typical steam cracker tar and a vacuum resid conducted at simulated visbreaker conditions including a temperature of 450° C. and 2861 kPa (400 psig) with steam injection, using visbreaker fractionation equipment that recovers steam cracker gas oil (SCGO), low sulfur fuel oil (LSFO), and residual tar streams. Results given in TABLE 2 below show that added steam reduces product asphaltenes level and increases SCGO yield.

TABLE 2

| | BOP Tar | | | Basrah Vacuum Resid | | |
|---|---|---|---|---|---|---|
| | Feed (wt %) | 450° C./ 2861 kPa | 450° C./ 2861 kPa | Feed (wt %) | 450° C./ 2861 kPa | 450° C./ 2861 kPa |
| $H_2O$/HC | | 0 | 0.5 | | 0 | 0.5 |
| <293° C. | 21 | 27 | 42 | 0 | 15 | 15 |
| 293°-566° C. | 41 | 40 | 30 | 19 | 40 | 44 |
| >566° C. | 15 | 9 | 10 | 69 | 24 | 28 |
| Asphaltenes | 23 | 24 | 18 | 12 | 21 | 13 |

The present invention is especially suited to economically advantageous use of steam cracker tars by heat treating them in the presence of steam to reduce formation of asphaltenes and other tar molecules. The overall yield of tar produced by steam cracking can be reduced significantly by the invention and the tar produced can be fluxed using gas oil by-products from the invention to produce upgraded tar products.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

In other embodiments, the invention may include:

1. A process for upgrading tar-containing effluent from a steam cracker furnace comprising: a) feeding a hydrocarbon feedstock having a final boiling point above 260° C. to a steam cracking furnace containing a radiant section outlet producing a steam cracker tar-containing effluent; b) adding steam to at least a portion of the steam cracker tar-containing effluent of the radiant section outlet, while the tar-containing effluent is at a temperature of from 300° C. to 850° C. to form a steam-effluent mixture; and c) separating the steam-effluent mixture into i) at least one tar-lean product containing a first tar; and ii) a tar-rich product containing a second tar, the tar-rich product having a final boiling point above the final boiling point of the at least one tar-lean product.

2. The process of paragraph 1, wherein the asphaltene concentration in the second tar is no greater than a comparative asphaltene concentration in a steam cracker tar within a steam cracker tar-containing effluent without the step b) addition of steam.

3. The process of paragraph 1, wherein the steam is added in step b) between the radiant section furnace outlet and a primary fractionator.

4. The process of paragraph 1, wherein the steam-effluent mixture of step b) is processed under heat soaking conditions in a heat soaking process.

5. The process of paragraph 1, wherein at least a portion of the steam-effluent mixture of step b) is visbroken under visbreaking conditions in a visbreaking process.

6. The process of paragraph 1, wherein the step b) of adding steam to at least a portion of a steam cracker tar-containing effluent comprises adding at steam in an amount of water to hydrocarbon effluent ratio of at least 1:1 not including the amount of steam or water added to the feedstock prior to cracking the feedstock in the radiant section.

7. The process of paragraph 4, wherein the heat soaking conditions include temperatures of from 300° to 600° C., total pressures no greater than 1138 kPa, and heat soaking times ranging from 0.1 to 100 hours.

8. The process of paragraph 1, wherein step b) further comprises recovering at least a portion of the steam cracker tar-containing effluent as primary fractionator bottoms and the steam of step b) is added to the primary fractionator bottoms to form the steam-effluent mixture, wherein the steam-effluent mixture is further processed in at least one of a heat soaking process and a visbreaking process.

9. The process of paragraph 8, thereafter conducting step c), wherein the at least one tar-lean product comprises at least one of a low boiling steam cracker gas oil stream and a medium boiling stream of low sulfur fuel oil, and the tar-rich product comprises a high boiling stream.

10. The process of paragraph 9, which further comprises at least one of i) adding at least a portion of the steam cracker gas oil stream to the high boiling stream to provide a fluxed tar stream and ii) directing at least a portion of the fluxed tar stream to a partial oxidation reactor.

11. The process of paragraph 1, further comprising recovering at least a portion of the steam cracker tar-containing effluent as tar knock-out drum bottoms and the steam of step b) is added to the tar knock-out bottoms forming the steam-effluent mixture, wherein the steam-effluent mixture is further processed in at least one of a heat soaking process and a visbreaking process.

12. The process of paragraph 1, further comprising: 1) before adding steam according to step b), separating the steam cracker tar-containing effluent into i) at least one tar-lean product; and ii) a tar-rich product, the tar-rich product having a final boiling point above the final boiling point of the at least one tar-lean product; and 2) thereafter, adding steam according to step b) to the tar-rich product to from the steam-effluent mixture; and 3) separating the steam-effluent mixture according to step c).

13. An apparatus for upgrading tar-containing effluent from a steam cracker furnace comprising:

a) a steam cracker furnace useful for cracking a feedstock having a final boiling point above 260° C., the furnace having a radiant section outlet for discharging a steam cracker tar-containing effluent from the furnace;

b) at least one transfer line for conveying the steam cracker tar-containing effluent from the furnace to or between at least one vessels downstream of the furnace;

c) a steam line for adding steam to the steam cracker tar containing effluent downstream from the furnace through a steam inlet into at least one of the at least one transfer line and the at least one vessels, while the steam cracker tar-containing effluent is at a temperature of from 300° C. to 850° C. to form a steam-effluent mixture;

d) at least one separator for separating the steam-effluent mixture into i) at least one tar-lean product containing a first tar; and ii) a tar-rich product containing a second tar, the tar-rich product having a final boiling point above the final boiling point of the at least one tar-lean product.

14. The apparatus of claim 13, further comprising a separator upstream of the steam inlet to separate the steam cracker tar-containing effluent into i) at least one tar-lean product; and ii) a tar-rich product, the tar-rich product having a final boiling point above the final boiling point of the at least one tar-lean product;

15. The apparatus of claim 13, wherein the steam line introduces steam into the steam cracker tar-containing effluent at or downstream from a primary fractionator to form the steam-effluent mixture and the steam-effluent mixture is processed in a heat soaking vessel.

16. The apparatus of claim 13, wherein the steam line introduces steam into the steam cracker tar-containing effluent at or downstream from a primary fractionator to form the steam-effluent mixture and the steam-effluent mixture is processed in a visbreaking vessel.

17. The apparatus of claim 13, further comprising a primary fractionator downstream from the radiant outlet, the primary fractionator including a bottoms outlet for conveying at least a portion of the tar-rich product from the primary fractionator, and wherein the steam line adds steam to the tar-rich product downstream from the bottoms outlet.

18. The apparatus of claim 13, further comprising a tar knock-out drum, the tar-knockout drum including a tar-knockout drum bottoms outlet for conveying at least a portion of the steam cracker tar-containing effluent from the tar-knockout drum as the tar-rich product.

1A. The invention may in other embodiments include a process for upgrading tar-containing effluent from a steam cracker furnace that comprises:

a) contacting a steam cracker tar-containing effluent with steam and for a time, sufficient to convert at least a portion of the steam cracker tar to a mixture comprising lower boiling molecules and the steam cracker tar-containing effluent; and b) separating the mixture from step a) into i) at least one tar-lean product; and ii) a tar-rich product having a final boiling above the final boiling point of the at least one tar-lean product; wherein step a) includes at least one of:

1) contacting the steam cracker tar-containing effluent with steam added to the effluent in a transfer line downstream of a steam cracker furnace comprising a quench inlet, with the steam added through or downstream of the quench inlet; 2) contacting the steam cracker tar-containing effluent with steam under heat soaking conditions in a heat soaking vessel to which the steam is added; and 3) contacting the steam cracker tar-containing effluent with steam under visbreaking conditions in a visbreaker; and furthermore, adding the steam at least one location selected from A) at the separating step b), B) upstream of the separating step b), and C) downstream of the separating step b).

2A. The process according to paragraph 1A, further comprising heat soaking conditions that include temperatures from 200° to 600° C., total pressures no greater than 1138 kPa, and heat soaking times ranging from 0.01 to 100 hours, say, temperatures of 250° to 500° C., total pressures no greater than 448 kPa, and heat soaking times ranging from 0.1 to 10 hours.

3A. The process according to any of the preceding paragraphs wherein 2) is carried out on a steam cracker tar-containing effluent obtained as primary fractionator bottoms.

4A. The process according to paragraph 3A, which further comprises adding steam to the fractionator bottoms to provide a mixture, heating the mixture to at least 250° C., directing the heated mixture to the heat soaking vessel to effect formation of lower boiling molecules, and thereafter separating the resulting mixture to provide a low boiling steam cracker gas oil, a medium boiling stream of low sulfur fuel oil and a high boiling stream containing tar.

5A. The process according to paragraph 4A which further comprises at least one of i) adding at least a portion of the steam cracker gas oil stream to the high boiling stream to provide a fluxed tar stream and ii) directing at least a portion of the fluxed tar stream to a partial oxidation reactor for combusting.

6A. The process according to any of the preceding paragraphs wherein 2) is carried out on a steam cracker tar-containing effluent obtained as bottoms from a tar knockout drum.

7A. The process according to paragraph 6A wherein the tar knockout drum is upstream of a primary fractionator.

8A. The process according to paragraph 7A which further comprises separating effluent from the heat soaking vessel into fractions, which fractions can optionally provide at least one of a steam cracked gas oil stream, a low sulfur fuel oil stream, and a tar stream, which optionally further comprises adding at least a portion of the steam cracked gas oil stream to the tar stream.

9A. The process according to paragraph 8A which further comprises directing overheads from the tar knockout drum to a primary fractionator which provides a $C_4$-overhead stream, a steam cracked naphtha side stream, a steam cracked gas oil side stream, and a quench oil bottoms stream; which optionally further comprises directing the quench oil bottoms stream to the quench inlet of 1); and which optionally further comprises adding at least a portion of the steam cracked gas oil side stream to the tar knockout drum bottoms upstream of 2).

10A. The process of any of the preceding paragraphs further comprising directing the steam cracker tar-containing effluent to a tar knockout drum which provides steam cracker tar which is treated in accordance with step a), and wherein the steam is added to at least one of the tar knockout drum itself, a location upstream of the tar knockout drum, and a location downstream of the tar knockout drum.

11A. The process of paragraph 10A wherein step a) consists of 1) contacting the steam cracker tar-containing effluent in the transfer line downstream of a steam cracker furnace, with steam added to the transfer line at or downstream of the quench oil inlet; and optionally, wherein the tar knockout drum is upstream of a primary fractionator.

12A. The process of any of preceding paragraphs 10A and 11A which further comprises directing at least a portion of overheads from the tar knockout drum to the primary fractionator which provides a $C_4$-overhead stream, a steam cracked naphtha side stream, a steam cracked gas oil side stream, and a quench oil bottoms stream.

13A. The process of paragraph 12A which further comprises directing at least a portion of the quench oil bottoms stream to the quench inlet of the transfer line.

14A. The process of paragraph 12A which further comprises directing at least a portion of the steam cracked gas oil side stream to the steam cracker tar provided by the tar knockout drum.

15A. An apparatus for upgrading steam cracker tar from a steam cracker furnace which comprises: a transfer line comprising an inlet for receiving hot steam cracker furnace effluent containing steam cracker tar, a quench oil inlet, and an optional steam inlet at or downstream of the quench oil inlet, and a cooled effluent outlet; a separator comprising at least one of i) a tar knockout drum comprising an overhead outlet and a bottoms outlet for a steam cracker tar stream, and ii) a primary fractionator comprising an overhead outlet, at least one side outlet, and a bottom outlet, provided that, in the presence of the tar knockout drum, the primary fractionator bottoms outlet provides a stream of quench medium to the quench inlet, while in the absence of the tar knockout drum, the primary fractionator bottoms outlet provides a steam cracker tar stream; an optional heat soaking vessel comprising a steam cracker tar stream inlet, for receiving and holding the steam cracker tar under heat soaking conditions, and an outlet; an optional inlet for introducing steam at or upstream of the heat soaking vessel; an optional heater for adding heat to the steam cracker tar stream at or upstream of the heat soaking vessel; an optional heat soaking effluent separator for separating effluent from the heat soaking vessel into a steam cracked gas oil side stream, a low sulfur fuel oil side stream, and a tar bottoms stream; an optional visbreaker comprising a steam inlet, for receiving and holding the steam cracker tar under visbreaking conditions; an optional visbreaker effluent separator for separating effluent from the visbreaker into a steam cracked gas oil side stream, a low sulfur fuel oil side stream, and a tar bottoms stream; an optional partial oxidation unit for treating the tar bottoms stream from at least one of the heat soaking effluent separator and the visbreaker effluent separator; an optional line for introducing the steam cracked gas oil side stream to the tar bottoms stream; the primary fractionator optionally comprising at least one of an overhead outlet for a $C_4$-overhead stream, a side outlet for a steam cracked naphtha side stream, a side outlet for a steam cracked gas oil side stream, and a bottoms outlet for a quench oil bottoms stream; the primary fractionator optionally comprising at least one of an overhead outlet for a $C_4$-overhead stream, a side outlet for a steam cracked naphtha side stream, a side outlet for a steam cracked gas oil side stream, and a bottoms outlet for a steam cracker tar stream; and an optional line from the side outlet for a steam cracked gas oil side stream for adding fluxant to a steam cracker tar stream.

What is claimed is:

1. A process for upgrading tar-containing effluent from a steam cracker furnace comprising:

a) feeding a hydrocarbon feedstock having a final boiling point above 260° C. to a steam cracking furnace containing a radiant section outlet producing a steam cracker tar-containing effluent;

b) adding steam to at least a portion of said steam cracker tar-containing effluent while the tar-containing effluent is at a temperature of from 300° C. to 850° C. to form a steam-effluent mixture; and c) separating the steam-effluent mixture into i) at least one tar-lean product containing a first tar; and ii) a tar-rich product containing a second tar, the tar-rich product having a final boiling point above the final boiling point of the at least one tar-lean product.

2. The process of claim 1, wherein the asphaltene concentration in the second tar is no greater than a comparative asphaltene concentration in a steam cracker tar within a steam cracker tar-containing effluent without said step b) addition of steam.

3. The process of claim 1, wherein said steam is added in step b) between the radiant section furnace outlet and a primary fractionator.

4. The process of claim 1, wherein said steam-effluent mixture of step b) is processed under heat soaking conditions in a heat soaking process.

5. The process of claim 4, wherein the heat soaking conditions include temperatures of from 300° to 600° C., total pressures no greater than 1138 kPa, and heat soaking times ranging from 0.1 to 100 hours.

6. The process of claim 1, wherein at least a portion of said steam-effluent mixture of step b) is visbroken under visbreaking conditions in a visbreaking process.

7. The process of claim 1, wherein the step b) of adding steam to at least a portion of a steam cracker tar-containing effluent comprises adding at steam in an amount of water to hydrocarbon effluent ratio of at least 1:1 not including the amount of steam or water added to the feedstock prior to cracking the feedstock in the radiant section.

8. The process of claim 1, wherein step b) further comprises recovering at least a portion of said steam cracker tar-containing effluent as primary fractionator bottoms and said steam of step b) is added to said primary fractionator bottoms to form said steam-effluent mixture, wherein said steam-effluent mixture is further processed in at least one of a heat soaking process and a visbreaking process.

9. The process of claim 8, thereafter conducting step c), wherein said at least one tar-lean product comprises at least one of a low boiling steam cracker gas oil stream and a medium boiling stream of low sulfur fuel oil, and said tar-rich product comprises a high boiling stream.

10. The process of claim 9, which further comprises at least one of i) adding at least a portion of the steam cracker gas oil stream to the high boiling stream to provide a fluxed tar stream and ii) directing at least a portion of the fluxed tar stream to a partial oxidation reactor.

11. The process of claim 1, further comprising recovering at least a portion of said steam cracker tar-containing effluent as tar knock-out drum bottoms and said steam of step b) is added to said tar knock-out bottoms forming said steam-effluent mixture, wherein said steam-effluent mixture is further processed in at least one of a heat soaking process and a visbreaking process.

12. The process of claim 1, further comprising:

1) before adding steam according to step b), separating said steam cracker tar-containing effluent into i) at least one tar-lean product; and ii) a tar-rich product, the tar-rich product having a final boiling point above the final boiling point of the at least one tar-lean product; and
2) thereafter, adding steam according to step b) to said tar-rich product to from said steam-effluent mixture; and
3) separating said steam-effluent mixture according to step c).

13. The process of claim 1, wherein said steam is added to said steam cracker tar-containing effluent in at least one of 1) upstream of a tar knockout drum, 2) within said tar knockout drum, and 3) downstream of a tar knockout drum bottoms outlet for conveying a portion of said steam cracker tar-containing effluent from said tar knockout drum.

14. The process of claim 13, thereafter conducting step c) using at least one of said tar knockout drum and a primary fractionator, wherein said at least one tar-lean product comprises at least one of a low boiling steam cracker gas oil stream and a medium boiling stream of low sulfur fuel oil, and said tar-rich product comprises a high boiling stream.

15. The process of claim 14, further comprising adding at least a portion of said steam cracked gas oil stream to said high boiling stream.

16. The process of claim 13, further comprising directing an overhead vapor stream from the tar knockout drum to a primary fractionator which provides a $C_4$-overhead stream, a steam cracked naphtha side stream, a steam cracked gas oil side stream, and a quench oil bottoms stream.

17. The process of claim 16, further comprising recovering olefin products from at least a portion of said steam cracker tar-containing effluent.

18. The process of claim 16, further comprising adding at least a portion of the steam cracked gas oil side stream to a tar knockout drum bottoms stream.

19. The process of claim 1 wherein step b) consists of 1) contacting the steam cracker tar-containing effluent in the transfer line downstream of a steam cracker furnace, with steam added to the transfer line at or downstream of a quench oil inlet.

20. A process for upgrading tar-containing effluent from a steam cracker furnace fed with hydrocarbon feed having a final boiling point above 260° C. that comprises:

a) directly contacting a steam cracker tar-containing effluent with steam and for a time, sufficient to convert at least a portion of the steam cracker tar to a mixture comprising lower boiling molecules and the steam cracker tar-containing effluent; and
b) separating the mixture from step a) into i) at least one tar-lean product; and ii) a tar-rich product having a final boiling above the final boiling point of the at least one tar-lean product;

wherein step a) includes at least one of:

1) contacting the steam cracker tar-containing effluent with steam under heat soaking conditions in a heat soaking vessel to which the steam is added; and
2) contacting the steam cracker tar-containing effluent with steam under visbreaking conditions in a visbreaker.

* * * * *